United States Patent [19]

Saligny

[11] 4,277,643

[45] Jul. 7, 1981

[54] CONNECTING MEMBER FOR TELEPHONE SYSTEMS

[75] Inventor: Yves Saligny, Cluses, France

[73] Assignee: Etablissements Carpano and Pons, France

[21] Appl. No.: 35,079

[22] Filed: May 1, 1979

[30] Foreign Application Priority Data

May 18, 1978 [FR] France ..... 78 15657

[51] Int. Cl.[3] ..... H01R 31/08

[52] U.S. Cl. ..... 179/1 PC; 339/217 PS

[58] Field of Search ..... 179/1 PC; 339/19, 217 R, 339/217 PS, 217 TP, 219 R, 219 F

[56] References Cited

U.S. PATENT DOCUMENTS

| | | | |
|---|---|---|---|
| 2,875,425 | 2/1959 | Gilbert | 339/217 PS |
| 3,826,986 | 7/1974 | Brown et al. | 179/1 PC |

*Primary Examiner*—Joseph A. Popek

*Attorney, Agent, or Firm*—Robert E. Burns; Emmanuel J. Lobato; Bruce L. Adams

[57] ABSTRACT

A connecting member, notably for telephone systems, comprises a first thinner portion made of a single thickness of a flat unitary conducting element acting only as a conducting portion, and a second, relatively rigid portion comprising four times the thickness of the flat element by being bent flat three times accordion-like for constituting the connecting terminal. A third portion being also provided which comprises two thicknesses of the flat element. A fourth portion disposed between the first and third portions consists of an extension of two intermediate portions constituting the terminal adjacent a terminal disposed symmetrically thereto. The third and fourth portions are curved and each is adapted to cooperate resiliently with another connecting member, notably terminal strips, distributing strips and cable heads.

12 Claims, 6 Drawing Figures

CONNECTING MEMBER FOR TELEPHONE SYSTEMS

FIELD OF THE INVENTION

This invention relates to connecting members for telephone systems, of the type having a flat cross-section and comprising several sections of different thicknesses corresponding to different degrees of flexibility, respectively, in a direction perpendicular to the two opposite faces of said flat member.

DESCRIPTION OF THE PRIOR ART

In known connecting members of this character, such as those disclosed in the French Pat. No. 2.271.682, in fact, two sections having different thicknesses are provided. Certain thinner sections affording a greater flexibility are thinned out by re-rolling, and this obviously requires several additional machining operations. On the other hand, other, thicker sections are obtained by assembling and pressing a pair of flat conducting elements against each other and spot-welding this assembly. Actually, a certain mechanical bonding is obtained in this way, but if the welding is not perfect the electrical conductibility between the two welded conducting elements is not perfectly reliable; now this constitutes a drawback, notably in telephone systems in which it has been known for many years that the number of intermediate connections should be as low as possible.

SUMMARY OF THE INVENTION

It is the essential object of this invention to provide a connecting member of relatively simple design which, though capable of being manufactured at a low cost from a minimum amount of raw material, provides a highly reliable electrical conductibility and is free of any intermediate connections.

The connecting member according to this invention consists of a flat, unitary conducting element of which the thickness corresponds to that of the thinnest section of said connecting member. This unitary flat element is bent over flat on itself at least once so that the connecting member has its thickness multiplied in at least one of its other sections, and at least one portion of the conducting element, projecting from the thickest section, is so shaped that it is adapted to cooperate with another connecting member. In the present disclosure the term "bent over flat on itself" means that the material of the conducting element is bent on itself through 180° so that the faces of resulting superposed portions of the flat element, which are thus caused to register with each other, will be substantially pressed tight against each other to provide a thicker rigid portion which is substantially incompressible in a thickness direction.

According to a typical form of embodiment of this invention, the flat element is bent over flat on itself to form an odd number of plies or pleats and thus constitute a thicker portion of the connecting member; the two end portions of the flat element which project from the same side of this thicker portion are disposed with a relative, predetermined spacing, and so shaped as to enable them to cooperate with two other connecting members. According to a modified version of this form of embodiment, at least one of the two end portions of the flat element which projects from said thicker portion is bent over flat on itself at least once on at least one portion of its length; these end portions may be bent on one or the other side.

According to an alternate form of embodiment, the flat element is bent over flat on itself or pleated once or several times to provide a thicker portion of the connecting member; only one of the end portions of the flat element projects from said thicker portion and is so shaped that is can cooperate with another connecting member. According to a modified version of this form of embodiment, the end portion of the flat element which projects from said thicker portion is bent over flat on one or the other side on at least one fraction of its length.

According to a further modification applicable to the above-mentioned forms of embodiment wherein the flat element is bent over flat on itself and pleated at least three times to constitute one of the thicker portions of the connecting member, two portions of the flat element which are adjacent to an intermediate fold thereof (this fold being oriented in the same direction as the end portion or portions of the flat element which projects or project from said thicker portion) are extended so as to project likewise from this thicker portion on the same side as said end portion or portions. Moreover, these two portions of the flat element are so shaped as to be capable of cooperating with at least another connecting member.

In a modified form of embodiment the flat element is also bent over flat on itself at least three times to constitute one of the thicker portions of this connecting member. Two portions of the flat element, which are adjacent to an intermediate fold thereof, are extended in order to project from said thicker portion, and so shaped as to be capable of cooperating with at least another connecting member.

According to a modified version applicable to all of the aforesaid forms of embodiment, the portions of the flat element which, after the bending operation, lie flat on each other or on one another, have their registering faces bonded throughout their surface by means of a suitable adhesive substance introduced between said faces. Of course, it would not constitute a departure from the basic principles of the invention to bond only locally the portions of the flat element which lie flat on each other, for example by spot-welding or rivetting.

Various forms of embodiment of this invention will now be described with reference to the attached drawings, given by way of example.

DESCRIPTION OF THE PREFERRED EMBODIMENTS

Figure 1:
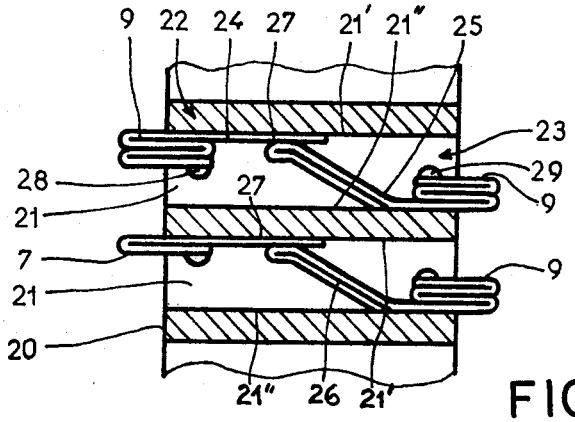
FIG. 1 is a cross-sectional view showing two typical forms of embodiment of the invention, incorporated in a distributing strip of the cut-off type.
Figure 2A:
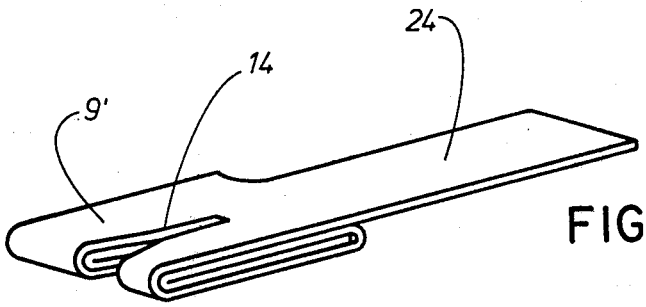
FIGS. 2A and 2B are perspective view of modified forms of embodiment of the connecting members shown in FIG. 1.

FIG. 1 illustrates two forms of embodiment of connecting members in accordance with the invention, intended for use for example in a cut-off wiring or distributing strip, notably for telephone systems. This strip comprises an insulating case 20 having a row of cavities 21 formed therein which open on either side of said case 20. Each cavity 21 has two opposite walls 21', 21" supporting connecting members 22 and 23, respectively. These connecting members 22 and 23 are made from flat elements 24 and 25, respectively. The first end portion of each flat element 24, 25 is folded or bent over flat on itself three times in the fashion of accordion-pleats to constitute a rigid terminal 9, or bent over flat on itself only once to constitute a so-called wrapper shank 7. The flexibility of these portions 9 and 7 is extremely low in a direction perpendicular to the two opposite faces of the connecting member. The rigid terminals 9 and 7 are therefore quite suitable for receiving the corresponding ends of connecting wires. For this purpose, slots 14 are advantageously formed at the ends of terminals 9, respectively, as shown in FIG. 2A in the case of terminal 9'. The second end portion 27 of each flat element 24, which projects from the thicker portion constituting a rigid terminal 9, is used as such, without any bending operation. Its thickness corresponds to a value just sufficient for conducting electric current. The other end portion of each flat element 25 which projects from the thicker portion constituting a rigid terminal 9 is bent over flat on itself once to constitute a blade 26 having a lesser flexibility than the end portion 27. The end of this blade 26 constantly tends to bear resiliently against the end portion 27. This end portion 27 has a cross-section just sufficient for conducting electric current. Its mechanical bending strength is reinforced by the corresponding wall 21'; therefore, it is unnecessary to increase its thickness. The connecting members 22 and 23 are riveted at 28 and 29, respectively, to the walls 21' and 21". Thus, the electrical continuity of the electric circuit is obtained between two corresponding terminals 9 via a blade 26 and a second end portion 27. To break this circuit, it is only necessary to insert an insulating element between each blade 26 and the corresponding second end portion 27.

Figure 2B:
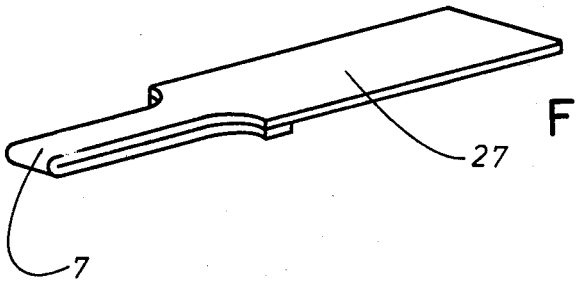

In the modified form of embodiment of the connecting member 24 illustrated in FIG. 2A, the rigid terminal 9' is obtained by bending the flat element by successively winding it in the same direction on itself. Thus, the flat element is bent three times on itself. As seen in FIG. 2B, the two ply portion 7 is narrower than the single ply portion 27.

Figure 3:
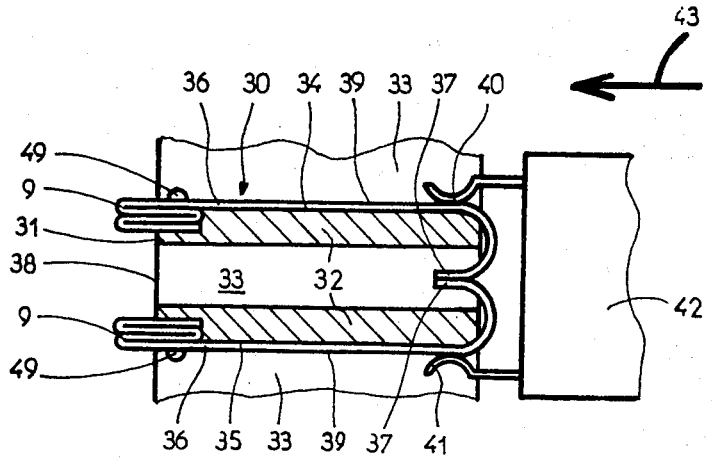
FIG. 3 is a cross-section showing a third form of embodiment of the invention, suitable for fitting to the head of a cable provided with protection means.

FIG. 3 illustrates a third form of embodiment of the connecting member according to this invention, which is intended for use, inter alia, in a protected cable end. In this example, the cable head comprises an insulating case 31 in which a plurality of aligned cavities 33 and walls 32 are formed and extend between the opposite faces thereof. The two opposite faces 34 and 35 of two adjacent walls 32 support each a connecting member 30 riveted at 49. These two connecting members 30 are identical and disposed symmetrically, as shown. They comprise each a rigid terminal 9, as already described with reference to the preceding forms of embodiment, and this terminal 9 consists of the first end portion of a flat conducting element 36 bent over flat on itself in accordion-like fashion to provide a four ply portion. The other end portion 37 of each flat element 36 is utilized as single ply; it is only bent to an arcuate configuration covering an arc of about 180° degrees, so that the two curved portions of each pair of connecting members 30 can bear resiliently against each other in the cavity 33 formed between the two walls 32 supporting each one of said connecting members 30. These two curved end portions 37 may thus provide the electrical continuity between the two terminals 9 disposed on the same face 38 of case 31. The intermediate portions 39 of each flat element 36 are pressed against the opposite outer faces 34 and 35, respectively. For example, they may be adapted to cooperate with the resilient terminals 40 and 41 of a protection module provided for protecting the corresponding line and adapted to be plugged in in the direction shown by the arrow 43.

Figure 4:
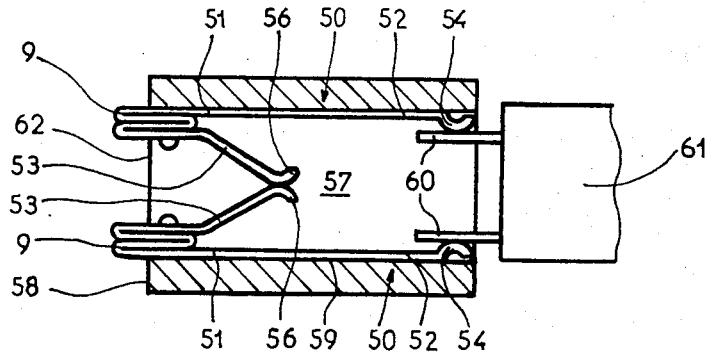
FIG. 4 illustrates in cross-section a fourth form of embodiment of the invention, suitable for use in a cable head also provided with protection means.

FIG. 4 illustrates a fourth form of embodiment of the connecting member of this invention, intended for use for example in a protection cable head. In this example each connecting member 50 consists of a flat connecting element 51 having its intermediate portion bent over three times accordion-like to constitute a four ply relatively rigid terminal 9, as already described hereinabove. Two single ply end portions 52 and 53 of the flat element 51 project from the thicker portion consisting of the terminal 9. The end portion 52 extends straight on and in coplanar relationship with the terminal 9, and comprises a curved end 54. The end portion 53 extends from the same side of the terminal 19 as the end portion 52 and is somewhat spaced therefrom. It also comprises a curved end 56. These connecting members 50 are utilized for example by pairs. Thus, two connecting members 50 may be disposed in face to face relationship in a cavity 57 extending through the case 58 of the protection-type cable head. Each end portion 52 is pressed against a face 59 of this cavity 57, and its curved end 54 is adapted to cooperate with a corresponding blade 60 projecting from a plug-in device 61 of the protection type. On the other hand, the two curved ends 56 contact each other in order to provide the electrical continuity between the two terminals 9 disposed on a same face 62 of case 58.

Figure 5:
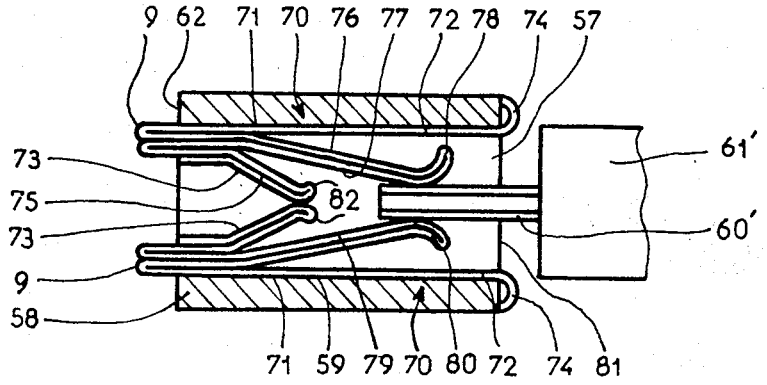
FIG. 5 illustrates in cross-section a fifth form of embodiment of the invention, also applicable to a cable head provided with protection means.

FIG. 5 illustrates a fifth form of embodiment of a connecting member according to this invention, also adapted for use for example in a protection cable head similar to the one described hereinabove. This connecting member 70 consists of a flat conducting element 71 having its intermediate portion bent over, for example three times accordion-like to constitute a relatively rigid four ply terminal 9 as already described hereinabove. Two end portions 72 and 73 of this flat element 71 project from the thicker portion consisting of the terminal 9. The single-ply end portion 72 extends straight on in coplanar relationship with the terminal 9, and comprises an end 74 curved in a direction away from the opposite end portion 73. The end portion 73 extends from the same side of the terminal 9 as the end portion 72 and is somewhat spaced therefrom. It is bent once on itself, throughout its length, so as to form a two-ply blade having a lesser flexibility than that of element 71. The end 82 of the flexible blade 75 thus obtained is also curved. On the other hand, two portions 76 and 77 of the flat element 71, which are adjacent the intermediate fold 78 of this element, project beyond the terminal 9, on the same side as the two end portions 72 and 73 of the flat element 71. The end of the flexible blade 79 thus formed further comprises a curved end portion 80. Consequently, this blade 79 is disposed between the two end portions 72 and 73.

These connecting members 70 are used for example by pairs. Two of them are disposed in face to face relationship in a cavity 57. Each end portion 72 is pressed against a face 59 of this cavity 57, and its bent end 74 bears against the face 81 of case 58 opposite the face 62. It constitutes for example an auxiliary contact constantly available as a test contact. On the other hand, the two curved ends 82 of the pair of corresponding blades 75 engage each other, thus providing the electrical continuity between the terminals 9 disposed on the face 62 of case 58. Finally, each curved end 80 of a blade 79 is adapted to cooperate with a corresponding blade 60' of a plug-in protection module 61'.

According to a modified form of embodiment, not shown in the drawings, the flat element is further bent accordion-like at least three times to constitute one of the thicker portions of said connecting member; only two portions of the flat element, which are adjacent to an intermediate fold thereof, are extended so as to protrude from said thicker portion, and shaped to enable them to cooperate with at least another connecting member. This last-mentioned connecting member might correspond for example to the member 70 illustrated in FIG. 5, wherein only the two portions 76 and 77 adjacent to fold 78 would subsist and thus project from the rigid terminal 9, the two end portions 72 and 75 being dispensed with so that they will not project beyond the terminal 9.

According to a modified version applicable to all the above-described forms of embodiment of the connecting member of this invention, the portions of the flat element which, after being bent over flat on themselves, are pressed against each other, have their registering faces advantageously but not compulsorily joined with each other through mechanical means, and possibly electrically, throughout their surface, by means of a bonding substance introduced between these faces. Thus, for example, these connecting members, after the bending step, may be dipped into a bath of molten metal, such as tin. The molten tin or like metal penetrates by capillarity into the narrow gaps left between the various portions of the flat element pressed against each other. This molten metal, while protecting the element against oxidation, improves the rigidity of terminals 9 and 7 and reduces the flexibility of the other end portions consisting of at least two portions pressed against each other. The electrical conductibility is also greatly improved.

The connecting member according to this invention may be used notably in terminal strips, distribution strips and cable heads, of the types currently employed notably in telephone systems.

What is claimed is:

1. A connecting member for telephone systems, having a flat cross-section and comprising several portions of different thicknesses which correspond to different flexibilities, respectively, in a direction across the two opposite faces of the flat member, said connecting member consisting of a unitary flat conducting element of uniform thickness which is equal to that of the thinnest portion of said connecting member, a portion of said flat conducting element being bent over flat on itself at least once with resulting superposed portions pressed tight against one another so that said connecting member has its thickness multiplied to form a thicker rigid terminal portion, at least one thinner portion of said flat conducting element, which projects from said thicker rigid portion, being shaped to cooperate with another connecting member.

2. A connecting member as claimed in claim 1, wherein an intermediate portion of said flat conducting element is bent to an accordion-like configuration an even number of times to constitute said thicker portion of said connecting member, two end portions of the flat conducting element projecting from the same side of said thicker portion and being somewhat spaced from each other, and shaped to cooperate with two other connecting members, respectively.

3. A connecting member as claimed in claim 2, wherein at least one of said end portions of said flat conducting element which project from said thicker rigid portion is bent over flat on itself at least once along at least one fraction of its length.

4. A connecting member as claimed in claim 1, wherein one end portion of said flat conducting element is bent over flat on itself at least once to constitute said thicker portion of said connecting member, another end portion of the flat conducting element projecting from said thicker portion and being shaped to cooperate with another connecting member.

5. A connecting member as claimed in claim 4, wherein said other end portion of said flat conducting element which projects from said thicker portion is bent over flat on itself at least once along at least one fraction of its length.

6. A connecting member as claimed in claim 1, wherein a portion of said flat conducting element is bent over flat on itself in the fashion of accordion pleats at least three times in order to constitute said thicker rigid portion of said connecting member, two portions of the flat conducting element which are adjacent to an intermediate fold of said element having extensions projecting from said thicker portion and shaped to cooperate with at least another connecting member.

7. A connecting member as claimed in claim 1, wherein an intermediate portion of said flat conducting element is bent over flat on itself in the fashion of accordion pleats at least three times in order to constitute said thicker rigid portion of the connecting member, and in which an end portion of said flat conducting element projects from one side of said thicker portion, two other portions of said flat conducting element, which are adjacent respectively to two intermediate folds of said thicker portion being oriented in the same direction as said end portion and having extensions which project from said thicker portion on the same side as said end portion, and being shaped to cooperate with at least another connecting member.

8. A connecting member as claimed in claim 1, wherein the portions of said flat conducting element which, after being bent over flat on themselves and pressed against each other, have their contacting faces bonded to each other throughout their surface areas by means of a bonding material between said faces.

9. A distributing strip for telephone systems comprising an insulating case having a row of cavities each having two opposite walls, and at least one connecting member in each of said cavities, said connecting member consisting of a flat unitary conducting element of uniform thickness, a portion of said flat conducting element being bent over flat on itself at least once with the resulting superposed portions pressed flat against one another to form a thickner, rigid multi-ply terminal portion from one side of which at least one thinner portion of said connecting member extends, and means for securing said rigid terminal portion of said connecting member to a wall of the respective cavity of said insulating case.

10. A distribution strip as claimed in claim 9, wherein said thinner portion comprises a single ply end portion of said conducting element which lies on and is supported by said cavity wall to which said rigid terminal portion is secured.

11. A distribution strip as claimed in claim 10, wherein an end portion of said single ply portion is curled over an edge of said cavity wall on which said single ply portion lies.

12. A distribution strip as claimed in claim 10, wherein a second end portion of said conducting element extends from the same side of said rigid terminal portion and is inclined away from said cavity wall on which said rigid terminal portion is secured, in position to engage a connecting member on the opposite wall of the same cavity of said insulating case.

* * * * *